US005727475A

United States Patent [19]

Kurtz

[11] Patent Number: 5,727,475

[45] Date of Patent: Mar. 17, 1998

[54] SIDE STAKE FOR ROTARY DUMP RAIL CAR

[75] Inventor: William E. Kurtz, Johnstown, Pa.

[73] Assignee: Johnstown America Corporation, Johnstown, Pa.

[21] Appl. No.: 667,368

[22] Filed: Jun. 21, 1996

Related U.S. Application Data

[63] Continuation of Ser. No. 413,914, Mar. 30, 1995, abandoned, which is a continuation of Ser. No. 267,577, Jun. 28, 1994, abandoned, which is a continuation of Ser. No. 160,825, Dec. 3, 1993, abandoned.

[51] Int. Cl.[6] ..... B61D 17/00

[52] U.S. Cl. ..... 105/406.1; 105/404

[58] Field of Search ..... 105/241.2, 241.1, 105/239, 404, 244, 406.1, 406.2, 409, 261.1, 264, 355; 298/10, 12, 14, 17 R, 17 B; 296/41; 220/1.5, 669

[56] References Cited

U.S. PATENT DOCUMENTS

| | | | |
|---|---|---|---|
| 725,213 | 4/1903 | Buhoup | 105/406.1 |
| 2,311,501 | 2/1943 | Woldok | 105/422 |
| 3,391,445 | 7/1968 | Miller | 105/406.1 |
| 3,421,453 | 1/1969 | Allen et al. | 105/406.1 |
| 3,868,914 | 3/1975 | Przbylinski | 105/406.1 |
| 4,361,097 | 11/1982 | Jones et al. | 105/406.1 |
| 5,070,793 | 12/1991 | Kurtz et al. | 105/404 |
| 5,178,074 | 1/1993 | Fetterman et al. | 105/406.1 |
| 5,373,792 | 12/1994 | Pileggi et al. | 105/406.1 |

*Primary Examiner*—Mark T. Le
*Attorney, Agent, or Firm*—Myers & Associates, Ltd.

[57] ABSTRACT

A rotary dump gondola rail car having side walls reinforced by vertical side posts. The side posts include a pair of vertical raised ribs projecting from the exterior face of the side walls for reducing wear between the side posts and a car dumper mechanism.

6 Claims, 2 Drawing Sheets

SIDE STAKE FOR ROTARY DUMP RAIL CAR

This application is a continuation of application Ser. No. 08/413,914, filed on Mar. 30, 1995, now abandoned; which is a continuation of application Ser. No. 08/267,577, filed on Jun. 28, 1994, now abandoned; and which is a continuation of application Ser. No. 08/160,825, filed on Dec. 3, 1993, now abandoned.

BACKGROUND OF THE INVENTION

1. Field of the Invention

This invention relates in general to gondola rail cars and more particularly, to improved side stakes having increased wear characteristics during rotary dumping operations.

2. Summary of the Prior Art

Gondola rail cars are common carriers of bulk materials including coal, sand, gravel and the like. A common design of a gondola car utilized in the industry employs concave floor panels, such as shown in U.S. Pat. No. 4,361,097 to Jones et al. issued Nov. 30, 1982. The concave troughs forming the floor panels significantly increase the load carrying volume of the car beneath the center sill and lower center of gravity for greater stability. The railroad gondola cars of the type shown in the foregoing Jones patent are designed for rotary dumping in which the car body is rotated on its side to discharge the bulk material being transported.

During dumping, the clamps of the dumper contact the top chord and lock the car as it rotates. As a result, the car shifts slightly and rests on the dumper side walls. After the load begins to empty, the truck springs begin to release and exert forces which cause the sides of the rail car to slide along the dumper side wall. The dumper clamps have release springs to relax them so that the truck spring forces are not all transferred to the clamp locations.

The side walls of such gondola cars of a rotary dump design are reinforced by a plurality of vertical side stakes for increased strength. Because of the sliding contact between the car side and the dumper side wall during rotation, the side stakes are subject to considerable frictional forces. As result of this frictional engagement during dumping, the side wall of the dumper tends to scratch and sometimes gouge the contacting faces of the side stakes. More severe damage can occur if there are any imperfections in either the side stakes or dumper side walls. Excessively deep scratches or wear can lessen the structural adequacy of the side stake members. Thus, the excessive wear not only mars the physical appearance of the rail car, but over a period of time physically decreases the structural cross section of the side stakes. It is accordingly desirable to provide improved side stakes for rail cars having means for resisting damage during rotary dump operations.

SUMMARY OF THE INVENTION

It is therefore an objective of the invention to provide improved ribbed side stakes for a rail car on which the stakes are vertically arranged along the side walls. The side stakes of the invention are provided with deepened ribs on their exterior faces to reduce the area of contact between the side walls of the dumper equipment and the contacting face of the side stakes. The raised ribs reduce the effects of excessive scratching and wear and provide a more structurally adequate side stake, even after being subjected to numerous dumping cycles over extended periods of time.

DESCRIPTION OF THE PREFERRED EMBODIMENT

Figure 1:
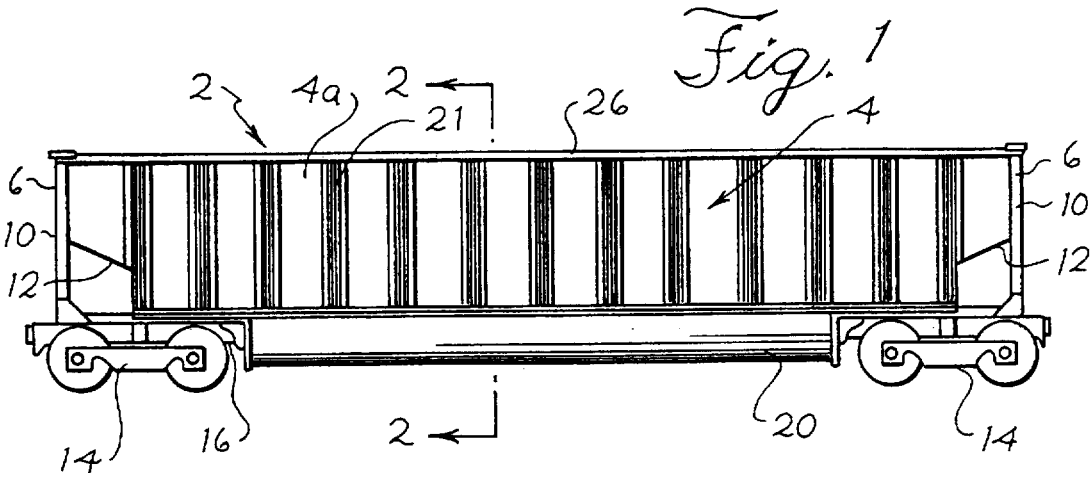
FIG. 1 is a side elevational view of a gondola car having the improved side stake of the invention.

Referring to FIG. 1, there is illustrated a gondola rail car for carrying commodities, such as bulk materials in the form of coal, sand, gravel and the like, and generally designated by the reference numeral 2. Gondola car 2 is of a rotary dump design capable of being rotated to a position to discharge its load through its open top. Although the invention is described with reference to gondola car 2, it is within the scope of the invention to employ its teachings in any rail car subject to conditions such as encountered during rotary dumping.

The gondola car 2 includes a pair of vertical side walls 4 having side sheets 4*a* and a pair of end walls 6. The end walls 6 have upper vertical portions 10 and lower vertical portions 12 which extend over conventional trucks 14 for distributing portions of the end loading. As partially seen in FIG. 2, a center sill 16 having a box beam shape extends substantially the full length of the car 2 between the trucks 14 and provides a support structure for concave floor panels 20. The floor panels 20 are constructed as a pair of tubs extending longitudinally on each side of center sill 16 along a substantial length.

Figure 2:
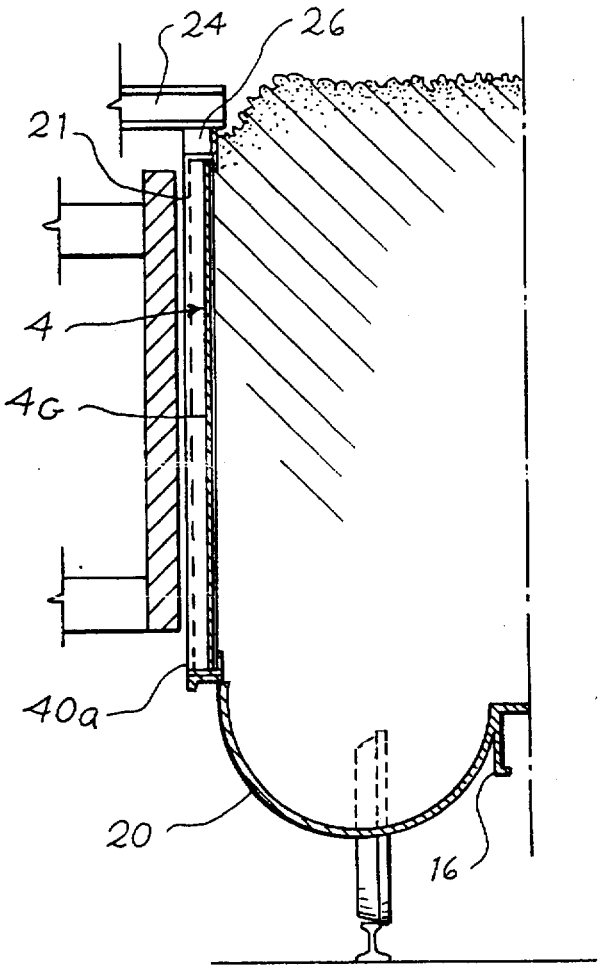
FIG. 2 is a partial end elevational view, with parts in section, of the gondola car of FIG. 1 taken along lines 2—2 and in position adjacent to the side wall of a dumper prior to rotation of the rail car.

The improved side stakes 21 of the invention are affixed to the outside of both side walls 14 at a plurality of positions along the length of the car 2. In FIG. 2, the side stakes 21 are shown positioned adjacent to a side wall 22 of a conventional rotary dumper mechanism commonly utilized in the railroad industry. Rotary dumper clamps 24 of conventional design lower and grip the upper chord 26, generally at four locations. The dumper clamps 24 lock the car during rotation from the upright position in FIG. 2 to a rotated position in FIG. 3. In FIG. 2 a clearance exists between the dumper side wall 22 and the side stakes 21 before the rail car is rotated for dumping.

Figure 4:
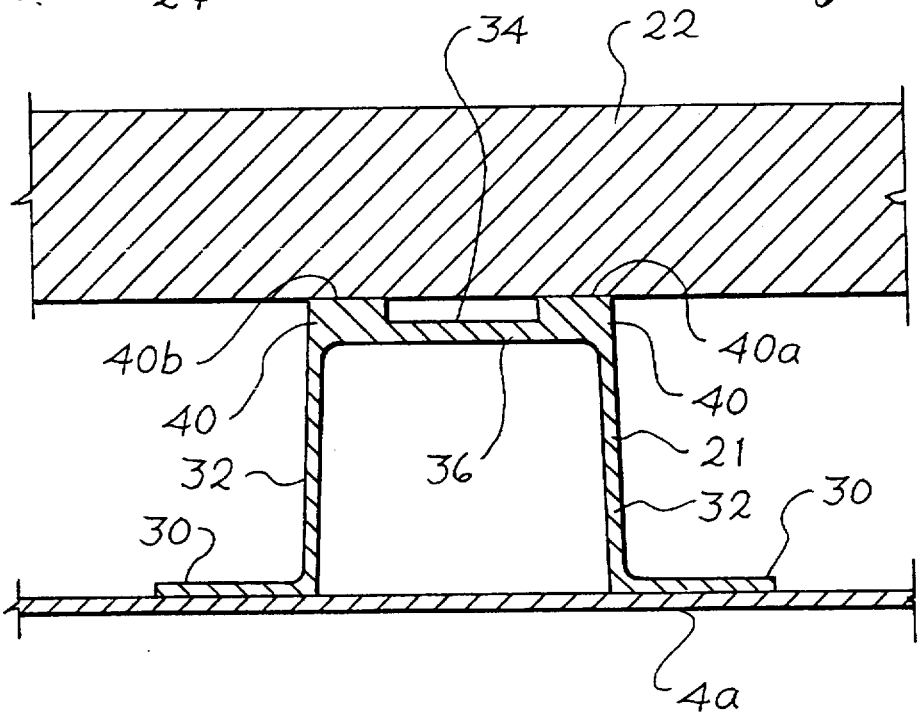
FIG. 4 is a partial plan view, with parts in section, showing the relation of the dumper side wall with the side stake during dumping.

The cross sectional configuration of the ribbed side stakes 21 is best shown in FIG. 4. The side stakes 21 are manufactured from a suitably durable metal, such as aluminum and the like. The side stakes 21 possess a generally hat-like configuration having a pair of vertical flanges 30 for attachment to the side sheets 4*a* of the car 2 and a pair of laterally extending spaced walls 32. The spaced walls 32 of side stakes 21 terminate with outer faces 34 formed by exterior walls 36 that are laterally disposed beyond outer surface of the car side walls 4. The exterior wall 36 includes outwardly projecting rib portions 40 which form surfaces 40*a* and 40*b* for contacting the dumper side wall 22 during a rotary dump operation.

Figure 3:
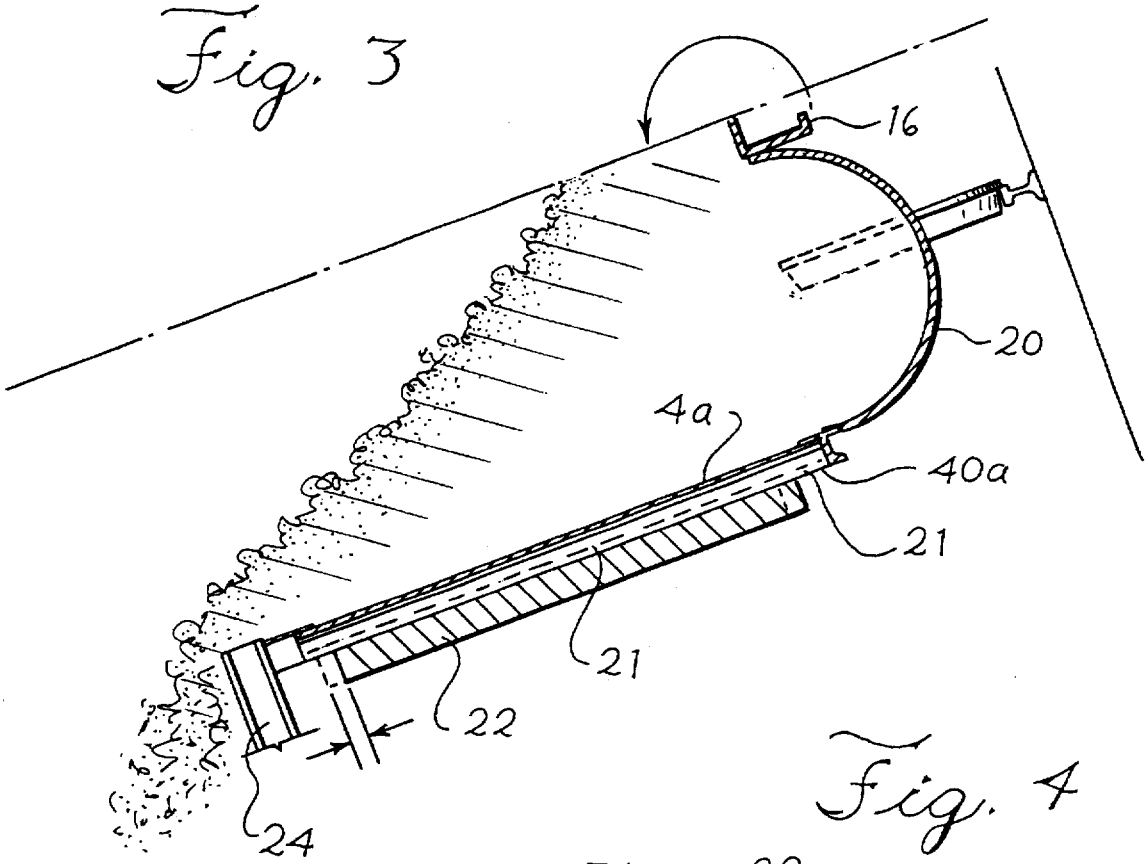
FIG. 3 is a partial end elevational view, with parts in section, of the gondola car of FIG. 1 during dumping operation adjacent the dumper side wall.

As the gondola car 2 is rotated in a conventional manner as shown in FIG. 3, the side stakes 21 move in contacting relation along the dumper side wall 22 as the truck springs (not shown) release and the dumper clamps 24 relax. The faces 40*a* and 40*b* are the sole surfaces of the side stakes 20 in contact with the dumper. Because contact between the dumper side wall 22 and the ribbed side stakes 21 only occurs at the faces 40*a* and 40*b* of the rib portions, damage to the side stake 21 from frictional contact is prevented to alleviate the problems of gouging, or marring of the side stakes that produces undue wear and reduction of strength as occurs in conventional exterior posts.

What is claimed is:

1. A rail car capable of undergoing rotation by a dumper mechanism for unloading comprising a car body being carried by a pair of truck assemblies, said car body having a pair of side walls, said side walls including a plurality of exterior vertical side stakes, said side stakes each having a pair of flanges affixed to one of said side walls, a pair of laterally extending walls projecting outward from said pair of flanges, an outer portion affixed to said laterally extending walls, at least some of said outer portions of said side stakes terminate with an exterior face lying in spaced lateral relationship to said flanges for contacting the dumper mechanism during rotation for unloading, means on said exterior face for minimizing wear during contact with the dumper mechanism during unloading, said means on said exterior face for minimizing wear reduces the area of contact between said face and the dumper mechanism, and said means on said exterior face includes rib means vertically extending along said face, said rib means providing raised surface areas for creating sole sliding moving contact between said side stakes and the dumper mechanism during unloading for reducing wear of said exterior faces of said side stakes.

2. The rail car according to claim 1 wherein said rib means includes a plurality of spaced vertical ribs projecting beyond said face.

3. The rail car according to claim 2 wherein said plurality of ribs form generally flat contact surfaces.

4. A rail car capable of being rotated by a dumper mechanism comprising a car body being carried by truck means, said car body having a pair of side walls and a pair of end walls, vertical side stakes affixed to at least one of said pair of side walls, said vertical side stakes each having a pair of flanges affixed to one of said side walls, a pair of lateral walls extending outward from said side walls, terminating with an outer portion vertically extending in parallel relationship to said side walls, and said outer portion of said vertical side stakes including an exterior face having a raised rib projecting beyond said exterior face for creating sole sliding contact between said side stakes and the dumper mechanism reducing friction and wear during relative movement between said face and the dumper mechanism during unloading.

5. The rail car according to claim 4 wherein said raised rib includes a plurality of raised vertical ribs.

6. The rail car according to claim 4 wherein said side stake includes a modified hat configuration having vertical flanges for attachment to said pair of side walls and an outer face, said raised rib being a pair of raised vertical ribs positioned on opposite sides of said face.

* * * * *